United States Patent [19]

Poole

[11] 4,316,506

[45] Feb. 23, 1982

[54] OIL WELL BLOW-OUT SAFETY SYSTEM

[75] Inventor: Douglas Poole, Jonesville, La.

[73] Assignee: Lizzy Emergency Systems, Inc., New Orleans, La.

[21] Appl. No.: 90,487

[22] Filed: Nov. 1, 1979

[51] Int. Cl.[3] ..... A62C 35/12

[52] U.S. Cl. ..... 169/69; 166/364

[58] Field of Search ..... 169/69, 47, 15, 44, 169/11, 16; 166/364, 53, 90

[56] References Cited

U.S. PATENT DOCUMENTS

| | | | |
|---|---|---|---|
| 1,567,097 | 12/1925 | Anthony | 166/90 |
| 1,582,238 | 4/1926 | Ardon | 166/90 |
| 2,000,381 | 5/1935 | Duffy | 166/90 |
| 2,041,394 | 5/1936 | Belcher | 169/69 |
| 2,080,610 | 5/1937 | Humason | 166/90 |
| 2,272,577 | 2/1942 | Penn | 169/44 |
| 2,307,083 | 1/1943 | Thrune | 169/47 |
| 3,620,299 | 11/1971 | Wiseman, Jr. | 169/69 |

*Primary Examiner*—Robert J. Spar

*Assistant Examiner*—Kenneth Noland

*Attorney, Agent, or Firm*—C. Emmett Pugh & Associates

[57] ABSTRACT

A system for delaying the ignition of, or for extinguishing, an oil well rig fire, by injecting an admixture of for example pressurized $CO_2$ and mono-potassium phosphate into the flow of hydrocarbons from the drill pipe and casing, through a plurality of holds in the wall of a spool apparatus located in the "stack" above the "Hydril" and blow-out preventers and above the casing but preferably below the mud return line element. The spool apparatus is equipped with a plurality of one-way check valves for receiving a plurality of conduits or chicksaw lines for transporting the chemicals from storage tanks to the spool apparatus. The entire system can be manually activated by a spring-loaded mechanism at the control head. Additionally, the system can be used to inject, for example, ammonium hydroxide to neutralize highly toxic gases, known as "sour" gases, arising during a blow-out.

7 Claims, 6 Drawing Figures

OIL WELL BLOW-OUT SAFETY SYSTEM

BACKGROUND OF THE INVENTION

1. Field of the Invention

The present invention relates to delaying the ignition of, and extinguishment following ignition of, an oil or gas fire on a oil drilling rig in a blow-out. More particularly, the present invention relates to a spool apparatus which is inserted in the "stack" around a section of drill pipe directly above and adjacent to the "Hydril" and fed by a plurality of conduits extending between the spool apparatus and a source of pressurized chemicals, which pressurized chemicals are injected through valve openings in the spool apparatus directly into the flow of hydrocarbons around the drill pipe upon activation of the system.

2. General Description and Prior Art

There is an ever-present danger of the occurence of a blowout and resulting fire on oil drilling rigs. The present invention provides equipment for delaying the ignition of such a fire in order to enable the workers to evacuate, or for extinguishing the fire in the event ignition does occur. It is a well recognized fact that the occurence of a blowout involves immediate danger to the lives and safety of workers on the oil platform, an enormous expense involved in controlling the blowout and extinguishing the resulting fire, the loss and waste of valuable fuel, and the detrimental effects to the surrounding environment.

At present, oil drilling rigs are equipped with one or more devices located around the drill pipe and above the casing for preventing blowouts called a blowout preventer (BOP). The blowout preventer, usually by a ramming action, is designed to smash, pinch and scissor the drill pipe shut hopefully closing off the flow of hydrocarbons in a blowout. Also, located above the BOP is situated the "Hydril" which apparatus is utilized for sealing around the drill pipe to prevent further loss of hydrocarbons after occurence of a blowout. However, should these two systems fail, and such has occured in the past, the catastrophic results iterated above ensue. Thus, there is a great need for an additional system which could at least delay the ignition, if not extinguish the fire, following a blowout in order to allow, for example, evacuation of the workers.

The BOP'S (usually numbering one to three) and the "Hydril" form a section of elements above the well casing called the "stack", as these elements are stacked one on top of the other around the drill pipe and connected to either by bolt-flange connections above the well casing and below the mud return line. All of this part of the well system is located below the oil rig floor and its associated equipment.

For example, the Wiseman U.S. Pat. No. 3,620,299, issued Nov. 16, 1971, teaches the use of refrigerated $CO_2$ as a chemical to inject through a plurality of apertures in three set of extinguishment manifolds which surround the drill head, the $CO_2$ being injected adjacent to the drill head. Additionally Wiseman injects $CO_2$ through the drilling mud kill line into the casing below the blowout preventers. The Wiseman system, however, requires that an enourmous quantity of pure $CO_2$ gas be stored at 0° F. at 300 p.s.i. Also, the $CO_2$ is strayed on the exterior of the drill head once the blowout has occured and the hydrocarbons have been released into the atmosphere, or into the casing below the BOP'S which is a very high pressure area in a blowout, subject to great back pressure, and would not be effective and would cause severe problems including partial or complete isolation of the $CO_2$ from the hydrocarbons if the "Hydril" at least partially works. Wiseman U.S. Pat. No. 3,792,474, issued Jan. 1, 1974, regarding a method for extinguishing oil well fires, also teaches the use of refrigeraged $CO_2$ being injected outside of the drill head or into the casing below the BOP'S.

In both Wiseman patents, the $CO_2$ gas is used in pure form, refrigerated, and injected on the exterior of the drill head or into the flow of hydrocarbons within the casing. Also, the Wiseman patents require the utilization of elaborate electrical triggering mechanisms and securing mechanisms for the activation of the system.

The present invention can utilize highly pressurized $CO_2$ gas; however, in the invention this pressurized gas functions primarily as a press for chemical mono-potassium phosphate, and many other gaseous presses are available. Unlike the Wiseman process, the invention does not require refrigeration of the $CO_2$ in order to be put into use, since the present invention does not rely solely on $CO_2$ gas for accomplishing its objective. Also, unlike Wiseman, and other prior art references, the system of the present invention does not have its chemical injected outside of the drill head or into the casing below the BOP(s), but, rather, the spool apparatus of the invention, being located in the "stack", enables the admixture to be injected into the flow of hydrocarbons while the flow is still contained in the drill pipe stem, regardless of whether or not the "Hydril" and/or the BOP(s) work, since the areas of injection are in the "stack" above the BOP(s) and "Hydril" and above the casing rather than through it. This is an important feature.

Since the point of ignition of the flow of hydrocarbons can only occur after oxygen has been introduced occur after oxygen has been introduced into the flow, the injection of the $CO_2$ mono-potassium phosphate admixture enables the hydrocarbons to become saturated with the admixture, prior to exposure to the oxygen source in the surrounding atmosphere at the point of the blowout. This early introduction of the admixture while still in the casing will function to delay the ignition, if ignition occurs at all, and to possibly extinguish the fire following a blowout in the event the system is not activated prior to the fire commencing following the blowout.

An additional feature of the present invention is the manual activation of the system. It does not require the use of electrical systems for sensing or triggering the activation of the system, as does the Wiseman process. In fact, in the invention, the manual triggering mechanism may be located at various locations on the rig.

The following table lists a number of prior art devices and methods which have been patented and which involve the prevention of or ignition of oil well rig fires, and other related devices involved in the process.

| PRIOR ART PATENTS | | |
|---|---|---|
| 2,295,571 | H. Ensminger, et al | September 15, 1942 |
| 2,840,166 | J.E. Eckel, et al | June 24, 1958 |
| 3,620,299 | B.W. Wiseman, Jr. | November 16, 1971 |
| 3,692,117 | A.G. Wright | September 19, 1972 |
| 3,792,458 | J. Slack | January 1, 1974 |
| 3,782,474 | B.W. Wiseman, Jr. | January 1, 1974 |
| 3,905,424 | A.A. Elwood | September 16, 1975 |

The several prior art devices involved in the delaying of ignition or extinguishment of off-shore rig fires utilize in all cases the chemicals, principally $CO_2$, in a supercooled state, so that enough of the pure gas stored is available for success of the system. The result is that a costly and cumbersome refrigeration process is required. The liquified $CO_2$ must also be maintained under high pressure in its liquid state. The present invention is contrast would require no refrigeration of the chemicals whatsoever, and, although the $CO_2$ must be stored under pressure, such pressurization on oil rigs is easily accomplished. Additionally and more importantly the chemicals are injected directly around the drill string and directly into the hydrocarbon flow before exposure to the ambient, and above the BOP(s) and the "Hydril". Also the chemicals are mixed through the curious check valving sub-systems used in the present invention.

3. General Discussion of the Present Invention

The present invention provides for an apparatus and a method primarily for delaying the ignition of, and for possibly extinguishing, the combustion of an oil rig fire following a blowout. The invention is comprised of a spool apparatus which is incorporated in the "stack" located directly above and adjacent to the "Hydril" and below the mud return line element fixedly attached to each by a steel ring flange seal with bolts. The spool apparatus is so aligned that the spool's interior cylindrical vertical opening serves as part of the passageway for the return mud around the drill pipe.

A series of chicksaw conduits or lines connect to the spool at equal distances apart so that an independent line connects preferably in each quadrant of the spool's exterior circumference through a check valve. The conduit lines serve to transport the chemicals from the chemical course, or storage tanks, to the spool for injection into the interior of the spool into the flow of hydrocarbons should a blowout occur. The conduit lines would be equipped with a swivel manifold approximately, for example, every six feet, so as to achieve simple flexing between the storage tanks and the spool apparatus.

The source of the chemicals can be for example a series of three storage tanks supported upon a skid unit located in a convenient location on or near the rig platform. The skid units could contain for example one-3,000 pound high pressure cylinder, containing a chemical, for example mono-potassium phosphate, and two 500 pound cylinders containing pressurized carbon dioxide. The 3,000 pound cylinder would have extending out from it a control head through which the chemical mixture would flow to the spool apparatus. The control head valve could be for example activated through a spring-loaded head on the firing mechanism which could be manually operated.

In the event a blowout should occur during that crucial time between when the flow of the hydrocarbons are not prevented during delay or failure of the "Hydril" and/or blowout preventer(s), the present invention could be activated manually from various stations on the rig floor, triggering the spring loaded firing mechanisms. The activation would allow the $CO_2$ and K-PO4 to flow out of the tanks through the control head into the chicksaw lines further mixing again in the spool apparatus for injection through the four check valves into the flow of hydrocarbons around the drill pipe. The firing of the invention would cool the admixture of $CO_2$, K-PO4 and hydrocarbons at the drill head to 190° below 0° F., and mix with the flow of hydrocarbons flowing through the drill pipe, thus establishing a mixture of chemical and hydrocarbons which would be much less likely to ignite upon exposure to the atmosphere.

BRIEF DESCRIPTION OF DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
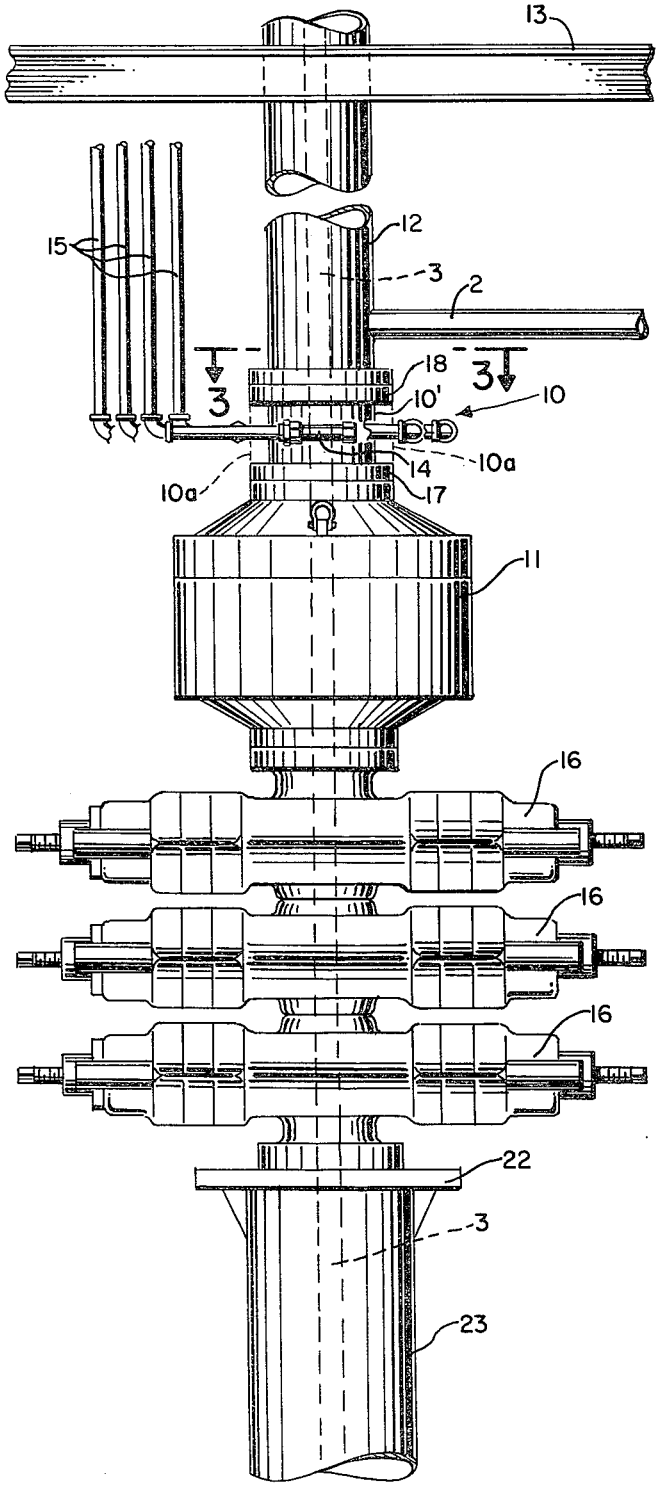
FIG. 1 is an close-up, side view of the preferred embodiment of the spool apparatus of the present invention showing its placement relationship below the mud return line and above the "Hydril" and the blowout preventer(s)
Figure 2:
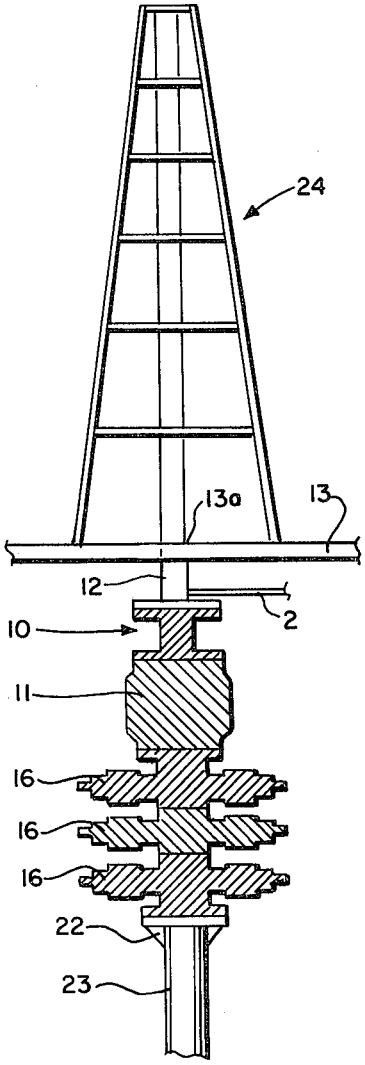
FIG. 2 is a side, generalized view of the preferred embodiment of the system of the present invention showing its placement relationship to the rig floor.

FIGS. 1 and 2 illustrate the preferred embodiment of the fire retardation or extinguishment spool apparatus 10 of the present invention, fixedly secured to the "Hydril" 11 by steel ring flange seal 17 on the bottom of the spool apparatus 10.

The spool apparatus 10 is fixedly attached to the mud return line element 12 below the mud return nipple 2 by the steel ring flange seal 18. The spool apparatus 10 is positioned in-line as part of the "stack" to the "Hydril" 11 and mud return line element 12 so as to accomodate the drill string 3 through its own vertical, center-line, cylindrical passage or bore 1.

Positioned on the exterior surface of the spool apparatus 10 at each quadrant, equidistant apart, is a check valve 14 for a total of four check valves around the exterior circumference of the spool apparatus 10. A conduit or chicksaw line 15 attached to each of the check valve 14, so that four chicksaw lines 15 lead into the four check valves 14. The chicksaw lines 15, which can be for example one to one-and-a-half inch lines, serve as a conduit for the pressurized $CO_2$ and monopotassium phosphate to flow from the course to the spool apparatus 10 for injection into the flow of hydrocarbons when the system of the present invention is activated. The four lines 15 can also have swivel manifolds for example every six feet.

FIG. 2 illustrates also very generally the position of the spool apparatus 10 in the "stack" in relation to: the "Hydril" 11, blowout preventer(s) 16, the casing hanger 22, and the drill pipe casing 23, all below it; and the mud return line element 12, the rig floor 13, and rig structure 24 above it. As is well known, the "Hydril" 11 and the BOP(s) 16 form a stack of safety devices which by means of rams or hydraulicly inflated seals or the like close off (or attempt to close off) the well across a horizontal plane to prevent the well from blowing out to the atmosphere in a blowout at the well head 13*a*. The position of the spool apparatus 10 directly above and adjacent to the "Hydril" 11 is very important so that the spool apparatus 10 may function at such point when and if either or both the "Hydril" 11 and/or the blowout preventer(s) 16 fail to completely prevent the flow of hydrocarbons through or around the drill pipe stem 3 in an emergency blowout situation. It is noted that in such a situation the blowout to the atmosphere would normally occur at the well head 13*a*, note FIG. 2, physically breaking the drill stem 3 and the well head elements at that area allowing the injected chemicals from spool 10 to have mixed and saturated the hydrocarbons before they are exposed to the oxygen of the atmosphere.

Figure 3:
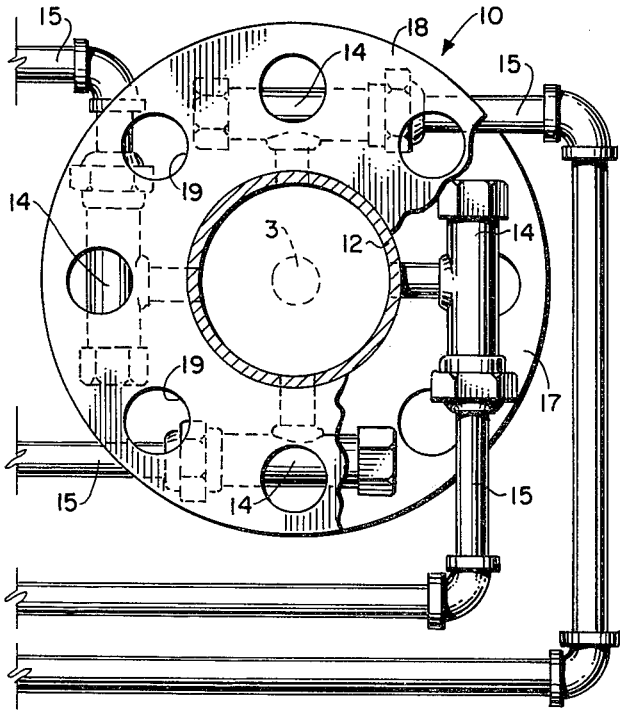
FIG. 3 is a cross-sectional, top view of the preferred embodiment of the apparatus of the present invention, illustrating the spool apparatus in relation to the drill stem, and the four check valves leading into the apparatus.

FIG. 3 illustrates more particularly a top, partial view of the spool apparatus 10 as it is positioned in line with the mud return line element 12 and also illustrates the equally spaced positions of the four check valves 14 and the flange connection holds 19 for the components of the spool apparatus 10 in their positions about the mud return line 12. As indicated by the illustration, the flow of hydrocarbons through the drill pipe stem 3 and the mud return line element 12 upwardly following a blowout, would release the admixture of $CO_2$ and K-PO4 through the check valves 14 into the central bore 1 to mix with the flow of hydrocarbons.

Figure 4:
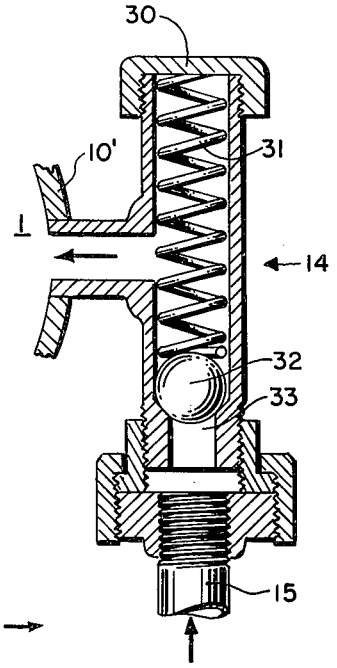
FIG. 4 is a cross-sectional, schematic, view of a typical one of the check valves showing the steel ball and spring mechanism of the valve in relation to the flow of chemicals through the valve to the drill stem.

FIG. 4 illustrates with particularity the check valve 14 of the preferred embodiment of the present invention. As can best be seen by FIG. 4, each check valve 14 is constructed with a removable nut 30 which allows upon its removal internal inspection of the valve. The check valve 14 includes a spring 31, with one end set against the inner surface of removable nut 30 and the other end attached to a steel ball seal 32. The steel ball seal 32, reacting to the pressure of the spring 31, is held tight against the opening or seat of the check valve 14, allowing no passage of the hydrocarbon flow back through check valve 14 and into the chicksaw lines 15. Upon manual activation of the entire system, the flow of the pressurized $CO_2$ and K-PO4 through the checksaw lines 15, in the direction of the drill pipe stem 3, would upon impact against the steel ball seal 32, create sufficient pressure to depress the spring 31, to allow the flow of $CO_2$ and K-PO4 admixture through the opening 33 of check valve 14, and into the flow of hydrocarbons around and in the drill pipe stem 3. The check valves 14 can be made to withstand for example pressures of 10,000 pounds.

Figure 5B:
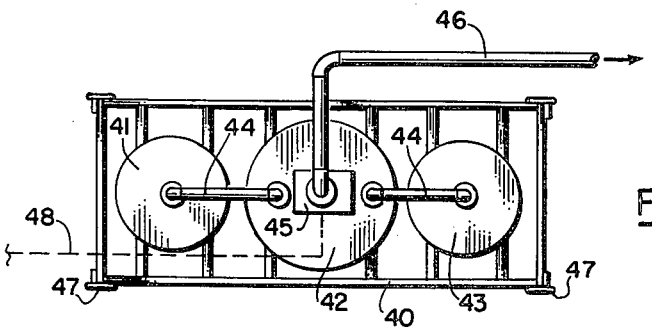
FIGS. 5A and 5B are side and top view, respectively, of the skid unit housing the storage tanks for the $CO_2$ and K-PO4 and the control head through which the chemicals flow.
Figure 5A:
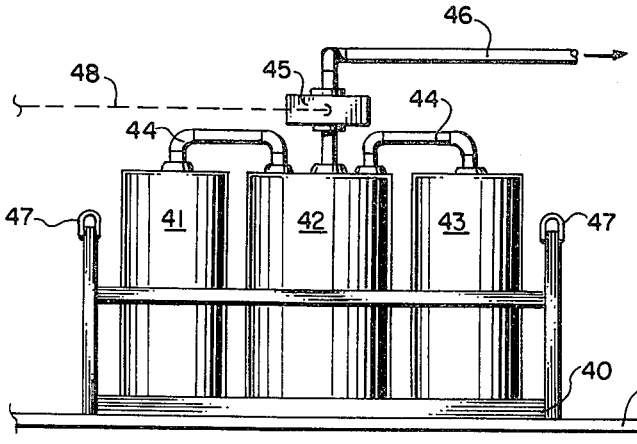

FIGS. 5A and 5B illustrate with particularity, from a side view and top view, respectively, the skid unit of the preferred embodiment of the present invention which houses the storage tanks 41, containing for example 500 pounds of pressurized $CO_2$, storage tank 42 containing for example 3000 pounds of mono-potassium phosphate, and tank 43 containing for example six feet by ten feet in horizontal dimensions.

FIGS. 5A and 5B also illustrate the conduit 44 which connects storage tank 43 to storage tank 42. Also, as further illustrated, the control head 45, situated above tank 42, receives the chemicals from the storage tanks 41, 42, 43, upon activation of the system.

The connection of the storage tanks 41, 42, and 43, as illustrated in FIGS. 5A and 5B, are such that, upon manual activation of the spring-loaded head of the firing mechanism, the $CO_2$ gas pressurized in tanks 42 and 43 would flow, via storage tank 43, carrying mono-potassium phosphate with it, as it flowed into control head 45, through conduit 46, to be delivered into the four chicksaw lines 15 to the check valves 14 and mixed in the spool apparatus 10 for injection into the flow of hydrocarbons around and in the drill stem 3.

As can be seen from the foregoing, the spool 10 is incorporated above the "Hydril" 11 and the blow-out preventer(s) 16, which are the two existing sub-systems presently in the "stack" on rigs designed to prevent a blowout. The system of the present invention thus serves as a third emergency as the blow-out preventers are closing. It further should be appreciated that the spool 10 directly communicates through its bore 1 with the exterior of the drill pipe 3 well above the casing 23, and does not enter through the well casing 23 which would possibly subject it to high pressures. By its placement, the spool 10 can be added without modifying any present equipment configuration or weakening any present equipment already on the rigs.

Because the chemicals used will drop the temperature to 190° below 0° F., the system of the present invention can be used to freeze the drill stem 3.

The configuration of the spool 10 need not of course be precisely as illustrated. For example, rather than in the classical form of a "spool" as shown, by making its vertical dimension less (going for example from 10 inches to four inches), the spool 10 could be made in the form of a wafer having a generally constant diameter (note phantom lines 10*a*). Additionally the system can be used to inject for example ammonium hydroxide to neutralize any highly toxic gases, known as "sour" gases, arising during a blowout.

Because many varying and different embodiments may be made within the scope of the inventive concept herein taught, and because many modifications may be made in the embodiment herein detailed in accordance with law the details herein are to be interpreted as illustrative and not in a limiting sense.

What is claimed as invention is:

1. A system for delaying the ignition of and assisting in the extinguishing of a fire around the oil pipe stem on an oil drilling rig during a blowout by injecting chemicals into the flow of hydrocarbons in the drill stem before the hydrocarbons are exposed to the ambient at the well head, the drilling rig having a stack of safety devices for horizontally closing off the well located between the well casing and the rig floor and below the mud return line element, comprising:

a. spool chemical injection apparatus incorporated as an in-line section of the stack above the safety devices but below the rig floor and having one-way flow valve means associated therewith for allowing the injection of pressurized chemicals directly into the flow of hydrocarbons in the drill pipe before the hydrocarbons are exposed to the atmosphere above the safety devices; said spool apparatus further including i. steel ring flange seal means at each vertical end of said spool apparatus for fixedly attaching the ends of said spool apparatus at the bottom to the upper most one of the safety devices and at the top to the mud return line element;

ii. a plurality of check valves located equidistant from one another around the exterior, circumferential surface of said spool apparatus with each connected to said conduit means; and iii. openings in the exterior surface of said spool apparatus at each location of each said check valve extending from said check valve through the wall of said spool apparatus to the interior surface of said spool apparatus for injecting chemicals from said check valve to the flow of hydrocarbons within said spool apparatus;

b. conduit means attached to said check valve means on said spool injection apparatus for transporting the chemicals from storage to said spool injection apparatus;

c. a storage source of chemicals associated with the rig and operatively connected to said conduit means; and d. activation means associated with said conduit means for activating the system for delivery of the chemicals when desired to said spool injection apparatus and into the flow of hydrocarbons.

2. The system of claim 1, wherein each said check valve has a valve passageway and a removable nut at one end and a moveable ball at the other end and further comprises:

a. spring means attached to said removable nut on one end of the valve passageway and to said moveable ball on the other end, wherein said spring contracts upon contact of said ball by pressurized chemicals flowing in the direction of the interior of said spool apparatus, said steel ball moving to a point in the passageway that the chemicals have free passage to the valve opening into said wall of said spool apparatus for injection of the chemicals into the flow of hydrocarbons in the interior of said spool apparatus.

3. The system of claim 1 wherein the chemicals injected into the flow of hydrocarbons is a mixture of a pressurized gaseous press and mono-potassium phosphate.

4. The system of claim 1 wherein said conduit means comprises:

a. a conduit, in the form of a flexible chicksaw line, connected to each check valve on the outer surface of the spool apparatus and to the storage means of chemicals on the rig for transport of the chemicals upon activation of the system.

5. The system of claim 4, wherein the chicksaw line is equipped with a swivel joint approximately every six feet along its course.

6. The system of claim 1, wherein said storage source comprises:

a. a skid unit which houses a series of storage tanks for storage of the chemicals; and b. a series of conduits connecting the series of storage tanks to a single conduit which connects the storage tanks to a control head for distribution of the chemicals to said injection apparatus.

7. The system of claim 6, wherein said storage tanks include approximately one 3000 pound tank containing mono-potassium phosphate, and approximately two 500 pound tanks containing pressurized gaseous press.

* * * * *